US010008354B2

(12) United States Patent
Shi et al.

(10) Patent No.: US 10,008,354 B2
(45) Date of Patent: Jun. 26, 2018

(54) ADJUSTABLE ELECTROMAGNETIC RELEASE

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Zheng Shi, Shanghai (CN); Jisheng Sun, Shanghai (CN); Binhua Pan, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 1 day.

(21) Appl. No.: 15/024,330

(22) PCT Filed: Sep. 19, 2014

(86) PCT No.: PCT/CN2014/086922
§ 371 (c)(1),
(2) Date: Mar. 23, 2016

(87) PCT Pub. No.: WO2015/043424
PCT Pub. Date: Apr. 2, 2015

(65) Prior Publication Data

US 2016/0217959 A1 Jul. 28, 2016

(30) Foreign Application Priority Data

Sep. 24, 2013 (CN) ..... 2013 1 0438966

(51) Int. Cl.
*H01H 71/24* (2006.01)
*H01F 7/08* (2006.01)
*H01H 71/74* (2006.01)

(52) U.S. Cl.
CPC ..... *H01H 71/24* (2013.01); *H01F 7/08* (2013.01); *H01H 71/2472* (2013.01); *H01H 71/7463* (2013.01)

(58) Field of Classification Search
CPC ..... H01F 7/08; H01H 71/24; H01H 71/2472; H01H 71/7463; H01H 71/525; H01H 1/2058
See application file for complete search history.

(56) References Cited

U.S. PATENT DOCUMENTS 5,870,008 A 2/1999 Pannenborg et al.
8,040,209 B2 * 10/2011 Faik ..... H01H 71/2472 335/172

(Continued)

FOREIGN PATENT DOCUMENTS

CN 1819096 A 8/2006
CN 201084663 Y 7/2008

(Continued)

*Primary Examiner* — Bernard Rojas
(74) *Attorney, Agent, or Firm* — Osha Liang LLP

(57) ABSTRACT

An apparatus having a conductor passing through a magnetic yoke and is mounted on the bracket, in which the magnetic yoke is fixed on the bracket as well. Above the conductor, a shaft is mounted on the top of the bracket. A push rod is mounted on the shaft and rotates with the shaft about the bracket. An armature, spaced apart from the magnetic yoke, is fixed on the push rod. Adjusting mechanisms are mounted on both sides of the shaft between the push rod and the bracket. Within the adjusting mechanism, a torsion spring is around the shaft. An adjusting rod is provided with a plurality of adjusting surfaces which makes contact with the adjusting mechanism. A spring force of the torsion spring enables the push rod to rotate towards a direction which makes the armature and the magnetic yoke separate.

7 Claims, 4 Drawing Sheets

(56) References Cited

U.S. PATENT DOCUMENTS

| | | | | |
|---|---|---|---|---|
| 9,425,013 | B2 * | 8/2016 | Augusta | H01H 50/18 |
| 2004/0251994 | A1 | 12/2004 | Tobin et al. | |
| 2008/0122563 | A1 | 5/2008 | Song | |

FOREIGN PATENT DOCUMENTS

| | | | |
|---|---|---|---|
| CN | 102543607 | A | 7/2012 |
| CN | 102779698 | A | 11/2012 |
| CN | 202678240 | U | 1/2013 |
| CN | 203103245 | U | 7/2013 |
| JP | 2011-238550 | A | 11/2011 |

* cited by examiner

ADJUSTABLE ELECTROMAGNETIC RELEASE

BACKGROUND OF THE INVENTION

1. Field of the Invention

The present invention relates to the electromagnetic release field, more particularly, relates to an adjustable electromagnetic release for large capacity circuit breakers.

2. The Related Art

Circuit breakers are electrical apparatuses for cutting off fault current such as overload current or short circuit current in circuits so as to protect circuit loads. The circuit breakers cut off the short circuit current via releases. The releases for cutting off short circuit current mainly include electromagnetic releases and electronic releases.

Usually, the releases are required to have different protection scopes in different working environments. Such requirements mean that the releases shall have adjustment abilities so as to satisfy different scales of short circuit current. FIG. 1 illustrates the structure of an electromagnetic release in the prior art. As shown in FIG. 1, according to the existing electromagnetic release, an air gap of an electromagnet is reduced via adjustment of an armature. When adjusting the air gap, a reaction spring is stretched and a resistant force of the spring is enlarged meanwhile. Therefore, there are two variables existed in the adjustment, when the initial attraction force enlarges, the initial reaction force enlarges as well. Such an adjustment mode is detrimental to the release rate adjustment of the release. This adjustment mode has low accuracy, sometimes it is not able to obtain the required release rate. Further, when adjusting the air gap, the required adjusting force may be very large due to the function of the reaction spring force, which may cause the adjustment be very difficult. If the material is not strong enough, the adjusting components may be damaged and will cause the circuit breaker be not adjustable.

SUMMARY

The present invention discloses an adjustable electromagnetic release with single variable adjustment ability.

According to an embodiment of the present invention, an adjustable electromagnetic release is disclosed. The adjustable electromagnetic release comprises: an armature, a magnetic yoke, a push rod, a conductor, a blocking piece, an adjusting piece, a shaft, an adjusting screw, a bracket, an adjusting rod and a torsion spring. The magnetic yoke is fixed on the bracket, the conductor passes through the bracket and the magnetic yoke and is mounted on the bracket. The shaft is mounted on the top of the bracket and is above the conductor, the shaft is rotatable about the bracket. The push rod is mounted on the shaft, the push rod rotates with the shaft about the bracket, the armature is fixed on the push rod, the armature and the magnetic yoke are spaced apart. Two adjusting mechanisms are mounted on the shaft, the two adjusting mechanisms are mounted on both sides of the push rod, and between the push rod and the bracket. The torsion spring is surrounded on the shaft, the torsion spring is positioned within the adjusting mechanism. One pin of the torsion spring is connected to the armature, the adjusting mechanism contacts with the push rod. The adjusting rod is provided with a plurality of adjusting surfaces, the adjusting mechanism contacts with the adjusting surfaces, the adjusting rod is able to move along the longitudinal direction. The spring force of the torsion spring enable the push rod rotates towards a direction which makes the armature and the magnetic yoke separate. When large current passes through the conductor, the armature and the magnetic yoke attract each other under the electromagnetic force. When the electromagnetic force is larger than the spring force, the push rod rotates towards a direction which makes the armature and the magnetic yoke close, the push rod strikes the release mechanism to release and cut off the circuit. The electromagnetic force disappears, the push rod resets under the spring force of the torsion spring.

According to an embodiment, the two adjusting mechanisms are disposed on both ends of the shaft respectively, each adjusting mechanism comprises a blocking piece and an adjusting piece. The blocking piece comprises a first plate and a second plate which are perpendicular to each other. The first plate is provided with an obround hole, the second plate is provided with a first shaft hole. The adjusting piece comprises a first side wall, a second side wall and a connecting wall which connects the first side wall and the second side wall. The first side wall has an extension section extending upwards, the first side wall is provided with a second shaft hole. A first arm is provided at the bottom of the extension section, the first arm contacts with the push rod and pushes the push rod. A second arm is provided at the top of the extension section. The second side wall is provided with a third shaft hole. The second shaft hole and the third shaft hole align to each other. The connecting wall is provided with a threaded hole.

According to an embodiment, the blocking piece is assembled with the adjusting piece, the second plate of the blocking piece is close to the inner side of the second side wall of the adjusting piece, the first shaft hole aligns to the third shaft hole, the shaft passes through the first shaft hole, the second shaft hole and the third shaft hole. The adjusting screw passes through the obround hole and the threaded hole, one end of the adjusting screw is screwed on the threaded hole, the adjusting screw is able to move in the obround hole, the blocking piece is able to rotate about the adjusting piece.

According to an embodiment, the outer side of the second side wall of the adjusting piece is close to the bracket, the outer side of the first side wall of the adjusting piece is close to the push rod.

According to an embodiment, the torsion spring is positioned between the second plate of the blocking piece and the first side wall of the adjusting piece. One pin of the torsion spring is connected to the inner side of the blocking piece, the other pin of the torsion spring is connected to a lower portion of the armature.

According to an embodiment, the adjusting rod is provided with a plurality of adjusting surfaces, the plurality of adjusting surfaces are arranged in pairs and are inclined. Two second arms of two adjusting pieces in two adjusting mechanisms are pressed on a pair of the adjusting surfaces.

According to an embodiment, the adjusting rod is provides with a gear rack, the gear rack enables the movement of the adjusting rod along the longitudinal direction.

When adjusting an instantaneous electromagnetic release rate of the electromagnetic release, the adjustable electromagnetic release of the present invention only adjusts the air gap as a single variable. The adjustable electromagnetic release has a small reaction spring force, a small volume and requires a small adjusting force.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

Figure 1:
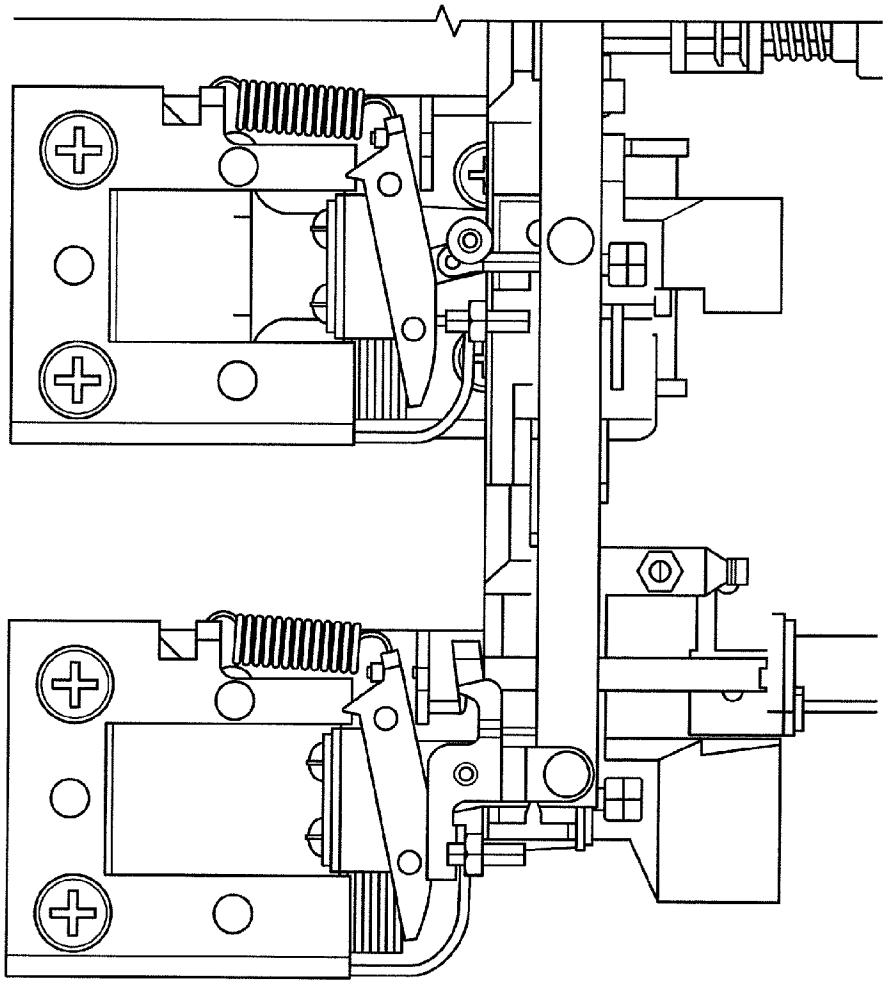
FIG. 1 (Prior Art)
FIG. 1 illustrates the structure of an electromagnetic release in the prior art.
Figure 2:
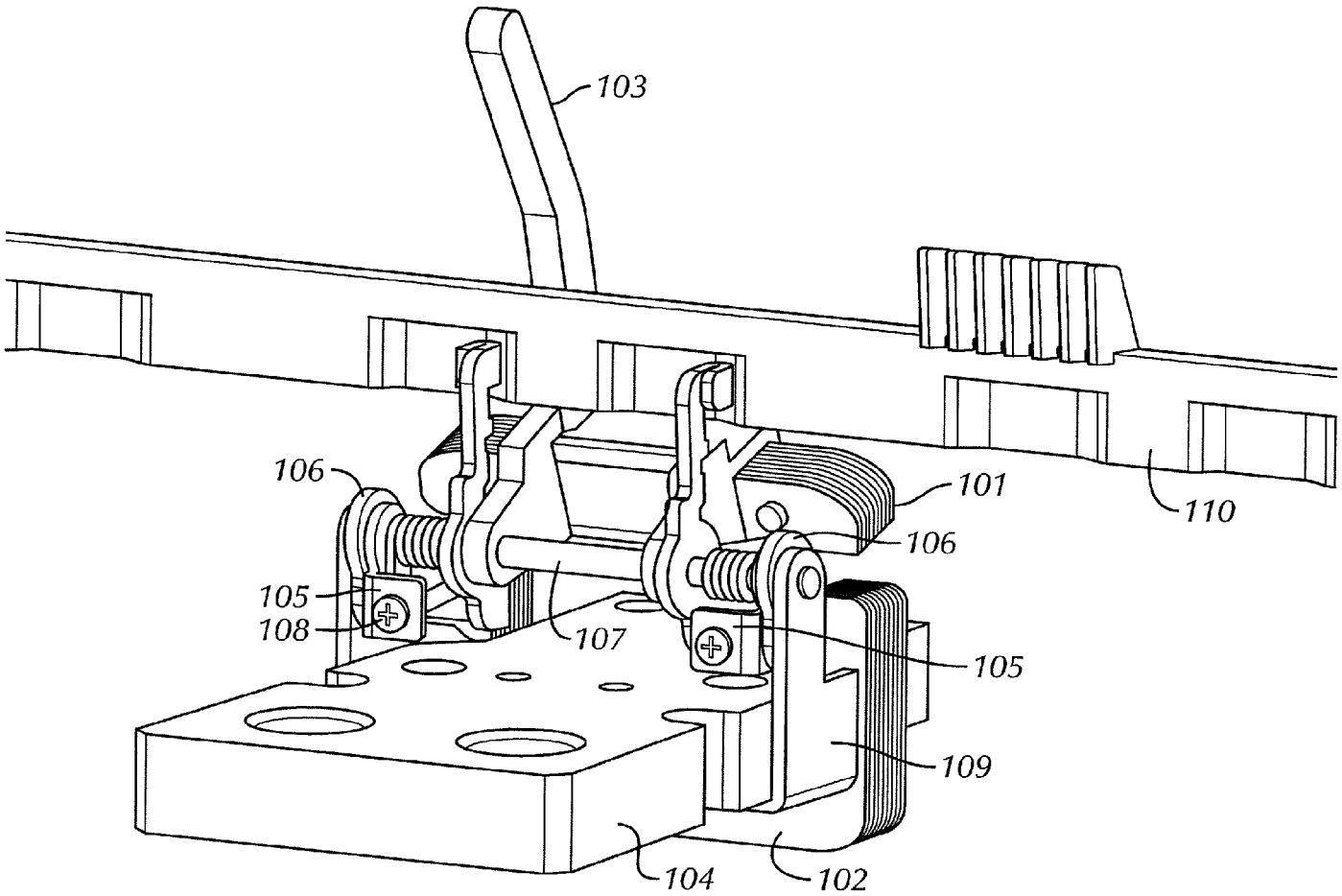
FIG. 2 illustrates the structure of an adjustable electromagnetic release according an embodiment of the present invention.

The present invention discloses an adjustable electromagnetic release. As shown in FIG. 2, the adjustable electromagnetic release comprises: an armature 101, a magnetic yoke 102, a push rod 103, a conductor 104, a blocking piece 105, an adjusting piece 106, a shaft 107, an adjusting screw 108, a bracket 109, an adjusting rod 110 and a torsion spring 120.

Figure 3:
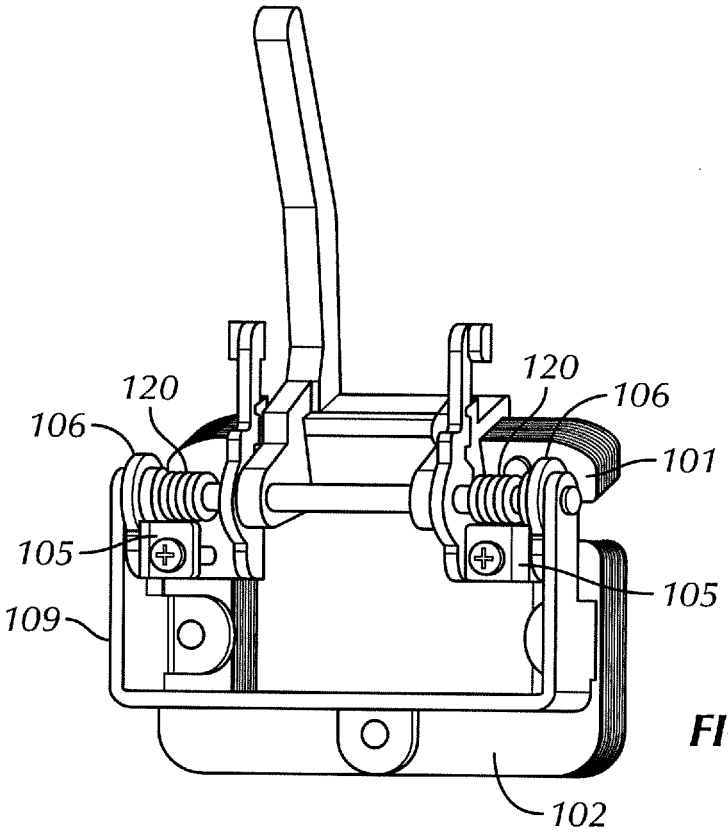
FIG. 3 illustrates the structure of an electromagnet of an adjustable electromagnetic release according an embodiment of the present invention.

As shown in FIG. 3, FIG. 3 illustrates the structure of the electromagnet. The magnetic yoke 102 is fixed on the bracket 109. In an embodiment, the magnetic yoke 102 is fixed on the bracket 109 through rivets. The conductor 104 passes through the bracket 109 and the magnetic yoke 102 and is mounted on the bracket 109. The shaft 107 is mounted on the top of the bracket 109 and is above the conductor 104. The shaft 107 is rotatable about the bracket 109. The push rod 103 is mounted on the shaft 107. The push rod 103 rotates with the shaft 107 about the bracket 109. The armature 101 is fixed on the push rod 103, and the armature 101 and the magnetic yoke 102 are spaced apart. Two adjusting mechanisms are mounted on the shaft 107. The two adjusting mechanisms are mounted on both sides of the push rod 103, and between the push rod 103 and the bracket 109. The torsion spring 120 is surrounded on the shaft 107, the torsion spring 120 is positioned within the adjusting mechanism. One pin of the torsion spring is connected to the armature 101. The adjusting mechanism contacts with the push rod 103.

Figure 4:
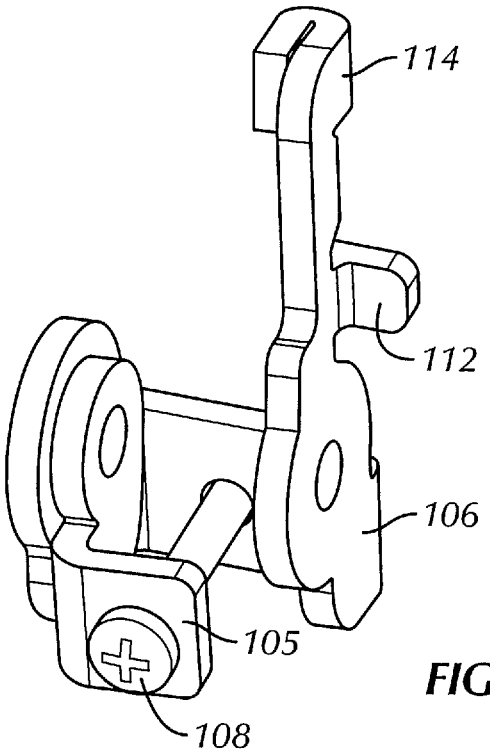
FIG. 4 illustrates the structure of an adjusting mechanism of an adjustable electromagnetic release according an embodiment of the present invention.
Figure 5:
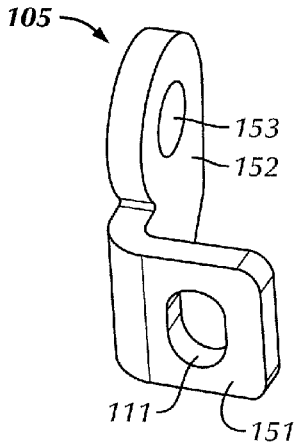
FIG. 5 illustrates the structure of a blocking piece of an adjustable electromagnetic release according an embodiment of the present invention.
Figure 6:
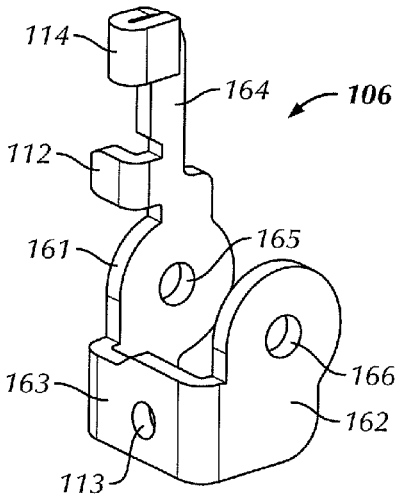
FIG. 6 illustrates the structure of an adjusting piece of an adjustable electromagnetic release according an embodiment of the present invention.

As shown in FIG. 4, FIG. 4 illustrates the structure of the adjusting mechanism. The two adjusting mechanisms are disposed on both ends of the shaft 107, respectively. Each adjusting mechanism comprises a blocking piece 105 and an adjusting piece 106. Further referring to FIG. 5, FIG. 5 illustrates the structure of the blocking piece. The blocking piece 105 comprises a first plate 151 and a second plate 152 which are perpendicular to each other. The first plate 151 is provided with an obround hole 111. The second plate 152 is provided with a first shaft hole 153. As shown in FIG. 6, FIG. 6 illustrates the structure of the adjusting piece. The adjusting piece 106 comprises a first side wall 161, a second side wall 162 and a connecting wall 163 which connects the first side wall and the second side wall. The first side wall 161 has an extension section 164 extending upwards. The first side wall 161 is provided with a second shaft hole 165. A first arm 112 is provided at the bottom of the extension section 164, the first arm 112 contacts with the push rod 103 and pushes the push rod 103. A second arm 114 is provided at the top of the extension section 164. The second side wall 162 is provided with a third shaft hole 166. The second shaft hole 165 and the third shaft hole 166 align to each other. The connecting wall 163 is provided with a threaded hole 113. Referring back to FIG. 4, the blocking piece 105 is assembled with the adjusting piece 106. The second plate 152 of the blocking piece 105 is close to the inner side of the second side wall 162 of the adjusting piece 106. The first shaft hole 153 aligns to the third shaft hole 166. The shaft 107 passes through the first shaft hole, the second shaft hole and the third shaft hole. The adjusting screw 108 passes through the obround hole 111 and the threaded hole 113. One end of the adjusting screw 108 is screwed on the threaded hole 113. The adjusting screw 108 is able to move in the obround hole 111. The blocking piece 105 is able to rotate about the adjusting piece 106. Referring back to FIG. 3, the outer side of the second side wall 162 of the adjusting piece 106 is close to the bracket 109. The outer side of the first side wall 161 of the adjusting piece 106 is close to the push rod 103.

The torsion spring 120 is positioned between the second plate 152 of the blocking piece 105 and the first side wall 161 of the adjusting piece 106. One pin of the torsion spring 120 is connected to the inner side of the blocking piece 105, the other pin of the torsion spring 120 is connected to a lower portion of the armature 101.

Figure 7:
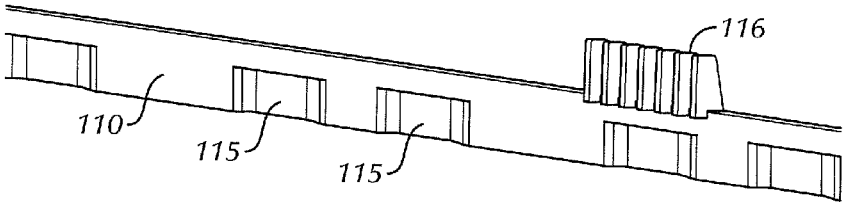
FIG. 7 illustrates the structure of an adjusting rod of an adjustable electromagnetic release according an embodiment of the present invention.

As shown in FIG. 7, FIG. 7 illustrates the structure of the adjusting rod. The adjusting rod 110 is provided with a plurality of adjusting surfaces 115. The adjusting mechanism contacts with the adjusting surfaces 115. The adjusting rod 110 is able to move along the longitudinal direction. The plurality of adjusting surfaces 115 are arranged in pairs and are inclined. The second arms 114 of the adjusting pieces 106 in two adjusting mechanisms (that is, two second arms 114) are pressed on a pair of the adjusting surfaces 115. The adjusting rod 110 is provided with a gear rack 116, which enables the movement of the adjusting rod 110 along the longitudinal direction.

The spring force of the torsion spring 120 enables the push rod 103 to rotate towards a direction which makes the armature 101 and the magnetic yoke 102 separate. When large current passes through the conductor, the armature 101 and the magnetic yoke 102 attract each other under the electromagnetic force. When the electromagnetic force is larger than the spring force, the push rod 103 rotates towards a direction which makes the armature 101 and the magnetic yoke 102 close. The push rod 103 strikes the release mechanism to release and cut off the circuit, the electromagnetic force disappears, the push rod 103 resets under the spring force of the torsion spring 120.

The working principle of the adjustable electromagnetic release is described hereafter. The torsion spring 120 is surrounded on the shaft 107 and positioned between the adjusting piece 106 and the blocking piece 105. One pin of the torsion spring 120 is connected to a lower portion of the armature 101 and the other pin of the torsion spring 120 is connected to the inner side of the blocking piece 105. The armature 101 and the push rod 103 may be regarded as an entirety as the armature 101 and the push rod 103 are relatively fixed. The armature 101 and the push rod 103 receive a torque from the torsion spring 120. The other pin of the torsion spring 120 is connected to the inner side of the blocking piece 105, so the blocking piece 105 receives a torque which makes the blocking piece 105 rotate outward. The torque was transmitted to the adjusting screw 108 from the blocking piece 105 through the obround hole 111. The blocking piece 105 is close against and pressed on the adjusting screw 108. The adjusting screw 108 is connected to the adjusting piece 106 through threaded connection, so the adjusting screw 108 and the adjusting piece 106 may be regarded as an entirety. When the adjusting screw 108 is fixed to a particular position, the adjusting piece 106 and the blocking piece 105 may be regarded as an entirety as well. The adjusting piece 106 and the blocking piece 105 form the adjusting mechanism. The adjusting mechanism as a whole receives a torque from the torsion spring 120. The adjusting piece 106 and the push rod 103 are arranged on a same shaft, the shaft 107. The adjusting piece 106 and the push rod 103 have the same rotation center, but the torque direction of the adjusting piece 106 and the push rod 103 are opposite. The first arm 112 of the adjusting piece 106 contacts with the push rod 103 and make the adjusting piece 106 and the push rod 103 to be an entirety. The spring force of the torsion spring 120 becomes an internal force and makes the entirety relatively fixed. The two adjusting pieces, the two blocking pieces and the two torsion springs are bilateral symmetric, respectively.

When the magnetic yoke 102 is mounted on the bracket 109, under the function of a reaction spring (the reaction spring is not shown in the drawings), the adjusting mechanism as a whole is pressed on the adjusting rod 110. As shown in FIG. 2, the second arms 114 of the adjusting pieces 106 are pressed on the adjusting surfaces 115 of the adjusting rod 110. The adjusting surfaces 115 are inclined and arranged in pairs. One pair of the adjusting surfaces 115 corresponds to two second arms 114. As shown in FIG. 7, the adjusting rod 110 is mounted on an appropriate position of the release and the adjusting rod 110 may only move along its longitudinal direction. During the movement of the adjusting rod 110, the second arm 114 of the adjusting piece 106 is always pressed on the adjusting surface 115 due to the function of the reaction spring. The contact position of the second arm 114 and the adjusting surface 115 is determined by the shape of the adjusting surface 115. The armature, the push rod and the adjusting mechanism rotate about the shaft 107 as an entirety to realize the adjustment of the air gap between the armature 101 and the magnetic yoke 102. During the rotating procedure, the spring force of the torsion spring 120 is an internal force and the spring force remains unchanged.

When large current passes through the conductor 104, the armature 101 and the magnetic yoke 102 attract each other under the function of the magnetic field. The armature 101 and the push rod 103 rotate about the shaft 107 towards a direction close to the magnetic yoke 102. The adjusting piece 106 follows the armature 101 to rotate as the adjusting piece 106 is pressed on the adjusting rod 110. One pin of the torsion spring 120 is pressed down by the armature 101 and the other pin of the torsion spring 120 is fixed in the adjusting mechanism. The spring force of the torsion spring 120 forms a reaction force to the armature 101. The armature 101 rotates under the electromagnetic attraction force and drives the push rod 103 to strike the release mechanism, so as to break the circuit breaker. When the circuit breaker is open, the electromagnetic force disappears and the torsion spring 120 drives the armature 101 and the push rod 103 to reset.

The initial reaction force to the armature 101 is generated by the torsion force of the torsion spring 120. The torsion force of the torsion spring 120 may be adjusted via the adjustment of the adjusting screw 108. By adjusting the adjusting screw 108 to change the screwed length which is screwed into the adjusting piece 106, the blocking piece 105 may rotate and drive the pin of the torsion spring 120 to rotate, then the initial reaction force of the electromagnet is adjusted. While adjusting the air gap of the electromagnet, the reaction force remains unchanged. Therefore, only one variable is adjusted and accuracy of the adjustment is significantly increased.

When the adjusting rod 110 is moving, the adjusting rod 110 only receives a friction force from the adjusting piece 106. The friction force is associated with the spring force of the spring which is in contact with the magnetic yoke. As the spring force is only a "pre pressure" which makes the adjusting piece pressed on the adjusting rod, the spring force may be a relatively small force, thus the friction force may also be small, which means only a small adjusting force is required to adjust the adjusting rod 110. A small adjusting force may bring great convenience to the users and avoid potential damages to the adjusting components. The gear rack 116 shown in FIG. 7 may be used to adjust the adjusting rod 110. It should be noticed that the adjusting mechanism of the adjusting rod 110 shall not be limited to the gear rack 116, other well-known mechanisms may be used to the adjusting rod 110 as well.

When adjusting an instantaneous electromagnetic release rate of the electromagnetic release, the adjustable electromagnetic release of the present invention only adjusts the air gap as a single variable. The adjustable electromagnetic release has a small reaction spring force, a small volume and requires a small adjusting force.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. An adjustable electromagnetic release comprising:

a magnetic yoke, wherein the magnetic yoke is fixed on a bracket;

a conductor, wherein the conductor passes through the bracket and the magnetic yoke and is mounted on the bracket;

a shaft, wherein the shaft is mounted on a top of the bracket and is above the conductor, the shaft is rotatable about the bracket;

a push rod, wherein the push rod is mounted on the shaft, the push rod rotates with the shaft about the bracket;

an armature, wherein the armature is fixed on the push rod, the armature and the magnetic yoke are spaced apart;

two adjusting mechanisms, wherein the two adjusting mechanisms are mounted on the shaft, the two adjusting mechanisms are mounted on both sides of the push rod, and between the push rod and the bracket, a torsion spring is disposed around the shaft, the torsion spring is positioned within both of the adjusting mechanisms, a first end of the torsion spring is connected to the armature, both adjusting mechanisms contact with the push rod, and wherein both adjusting mechanisms comprise a blocking piece, an adjusting screw, and an adjusting piece;

an adjusting rod, wherein the adjusting rod is provided with a plurality of adjusting surfaces, both adjusting mechanisms contact with the adjusting surfaces, the adjusting rod is able to move along a longitudinal direction;

a spring force of the torsion spring enables the push rod to rotate towards a direction to separate the armature and the magnetic yoke, when large current passes through the conductor, the armature and the magnetic yoke attract each other under the electromagnetic force, when the electromagnetic force is larger than the spring force of the torsion spring, the push rod rotates towards a direction to bring the armature and the magnetic yoke closer together, the push rod strikes a release mechanism, wherein the release mechanism is configured to release and cut off the circuit, the electromagnetic force disappears, the push rod resets under the spring force of the torsion spring.

2. The adjustable electromagnetic release according to claim 1, wherein the two adjusting mechanisms are disposed on both ends of the shaft, respectively;

the blocking piece comprises a first plate and a second plate which are perpendicular to each other, the first plate is provided with an obround hole, the second plate is provided with a first shaft hole;

the adjusting piece comprises a first side wall, a second side wall and a connecting wall which connects the first side wall and the second side wall, the first side wall has an extension section extending upwards, the first side wall is provided with a second shaft hole, a first arm is provided at the bottom of the extension section, the first arm contacts with the push rod and pushes the push rod, a second arm is provided at the top of the extension section, the second side wall is provided with a third shaft hole, the second shaft hole and the third shaft hole align to each other; the connecting wall is provided with a threaded hole.

3. The adjustable electromagnetic release according to claim 2, wherein the blocking piece is assembled with the adjusting piece, the second plate of the blocking piece is close to the inner side of the second side wall of the adjusting piece, the first shaft hole aligns to the third shaft hole, the shaft passes through the first shaft hole, the second shaft hole and the third shaft hole; the adjusting screw passes through the obround hole and the threaded hole, one end of the adjusting screw is screwed on the threaded hole, the adjusting screw is able to move in the obround hole, the blocking piece is able to rotate about the adjusting piece.

4. The adjustable electromagnetic release according to claim 3, wherein the outer side of the second side wall of the adjusting piece is close to the bracket, the outer side of the first side wall of the adjusting piece is close to the push rod.

5. The adjustable electromagnetic release according to claim 3, wherein the torsion spring is positioned between the second plate of the blocking piece and the first side wall of the adjusting piece, a second end of the torsion spring is connected to the inner side of the blocking piece, the first end of the torsion spring is connected to a lower portion of the armature.

6. The adjustable electromagnetic release according to claim 3, wherein the plurality of adjusting surfaces of the adjusting rod are arranged in pairs and are inclined, two second arms of two adjusting pieces in the two adjusting mechanisms are pressed on a pair of the adjusting surfaces.

7. The adjustable electromagnetic release according to claim 1, wherein the adjusting rod is provided with a gear rack, wherein the gear rack enables the movement of the adjusting rod along the longitudinal direction.

* * * * *